US007202764B2

(12) United States Patent
Deligianni et al.

(10) Patent No.: US 7,202,764 B2
(45) Date of Patent: Apr. 10, 2007

(54) NOBLE METAL CONTACTS FOR MICRO-ELECTROMECHANICAL SWITCHES

(75) Inventors: Hariklia Deligianni, Tenafly, NJ (US); Panayotis Andricacos, Croton on Hudson, NY (US); L. Paivikki Buchwalter, Hopewell Junction, NY (US); John M. Cotte, New Fairfield, NY (US); Christopher Jahnes, Upper Saddle River, NJ (US); Mahadevaiyer Krishnan, Hopewell Junction, NY (US); John H. Magerlein, Yorktown Heights, NY (US); Kenneth Stein, Sandy Hook, CT (US); Richard P. Volant, New Fairfield, CT (US); James A. Tornello, Cortlandt Manor, NY (US); Jennifer Lund, Brookeville, MD (US)

(73) Assignee: International Business Machines Corporation, Armonk, NY (US)

( * ) Notice: Subject to any disclaimer, the term of this patent is extended or adjusted under 35 U.S.C. 154(b) by 189 days.

(21) Appl. No.: 10/604,278

(22) Filed: Jul. 8, 2003

(65) Prior Publication Data

US 2005/0007217 A1 Jan. 13, 2005

(51) Int. Cl.
*H01H 51/22* (2006.01)

(52) U.S. Cl. ..... 335/78; 200/181

(58) Field of Classification Search ..... 335/78; 200/181
See application file for complete search history.

(56) References Cited

U.S. PATENT DOCUMENTS 5,479,042 A * 12/1995 James et al. ..... 257/415
6,016,092 A * 1/2000 Qiu et al. ..... 333/262
6,124,650 A * 9/2000 Bishop et al. ..... 310/40 MM
6,307,452 B1 * 10/2001 Sun ..... 333/262

OTHER PUBLICATIONS

"RF Mems Switches adn Switch Circuits" Gabriel M. Rebeiz, Jeremy B. Muldavin, IEEE Microwave Magazine, Dec. 2001 pp. 59-71.
"(Ba,Sr) TiO3 dielectrics for future stacked-capacitor DRAM" by D.E. Kotecki, J.D. Baniecki, H. Shen, R.B. Laibowitz, K.L. Saenger, J.J. Lian, T.M. Shaw, S.D. Athavale, C. Cabral, Jr., P.R. Duncombe, M. Gutsche, G. Kunkel, Y.-J. Park, Y.-Y. Wang, R. Wise, IBM J. Res, Develop. vol. 43 No. 3 May 1999.
IBM U.S. Appl. No. 60/339,089, filed Dec. 10, 2001, Christopher Jahnes, et al.

(Continued)

*Primary Examiner*—Lincoln Donovan
*Assistant Examiner*—Bernard Rojas
(74) *Attorney, Agent, or Firm*—H. Daniel Schnurmann

(57) ABSTRACT

A semiconductor micro-electromechanical system (MEMS) switch provided with noble metal contacts that act as an oxygen barrier to copper electrodes is described. The MEMS switch is fully integrated into a CMOS semiconductor fabrication line. The integration techniques, materials and processes are fully compatible with copper chip metallization processes and are typically, a low cost and a low temperature process (below 400° C.). The MEMS switch includes: a movable beam within a cavity, the movable beam being anchored to a wall of the cavity at one or both ends of the beam; a first electrode embedded in the movable beam; and a second electrode embedded in an wall of the cavity and facing the first electrode, wherein the first and second electrodes are respectively capped by the noble metal contact.

13 Claims, 16 Drawing Sheets

OTHER PUBLICATIONS

"Microswitches and Microrelays with a View Toward Microwave Applications" Paul M. Zavracky, Nicol E. McGruer, Richard H. Morrison, David Potter, Northeastern University, Boston, Massachusetts 02115, Analog Devices Wilmington, Massachusetts 01887.

"Micromechanical Switches Fabricated Using Nickel Surface Micromachining" Paul M. Zavracky, Sumit Majumder, and Nicol E. McGruer, Journal of Microelectromechanical Systems, vol. 6, No. 1, Mar. 1997.

* cited by examiner

NOBLE METAL CONTACTS FOR MICRO-ELECTROMECHANICAL SWITCHES

BACKGROUND OF INVENTION

Miniaturization of the front-end of the wireless transceiver offers many advantages including cost, the use of smaller number of components and added functionality allowing the integration of more functions. Micro-electromechanical system (MEMS) is an enabling technology for miniaturization and offers the potential to integrate on a single die the majority of the wireless transceiver components, as described by a paper by D. E. Seeger, et al., presented at the SPIE 27th Annual International Symposium on Microlithography, Mar. 3–8, 2002, Santa Clara, Calif., entitled "Fabrication Challenges for Next Generation Devices: MEMS for RF Wireless Communications".

A micro-electromechanical system (MEMS) switch is a transceiver passive device that uses electrostatic actuation to create movement of a movable beam or membrane that provides an ohmic contact (i.e. the RF signal is allowed to pass-through) or a change in capacitance by which the flow of signal is interrupted and typically grounded.

Competing technologies for MEMS switches include p-i-n diodes and GaAs MESFET switches. These, typically, have high power consumption rates, high losses (1 dB or higher insertion losses at 2 GHz), and are non-linear devices. MEMS switches on the other hand, have demonstrated insertion loss of less than 0.5 dB, are highly linear, and have very low power consumption since they use a DC voltage and an extremely low current for electrostatic actuation. These and other characteristics are fully described in a paper by G. M. Rebeiz, and J. B. Muldavin, "RF MEMS switches and switch circuits", published in IEEE Microwave, pp. 59–71, December 2001.

Patent application Ser. No. 60/339,089 now abandoned, describes a MEMS RF resonator fabrication process which utilizes IC compatible processes for fabrication of MEMS resonators and filters. In particular, the release method and encapsulation processes used are applied to the fabrication of RF MEMS switches.

U.S. Pat. No. 6,876,282 to Deligianni et al., of common assignee, herein incorporated by reference, describes the design of a MEMS RF switch wherein the actuators being totally decoupled from the RF signal carrying electrodes in a series switch. If the actuation and RF signal electrodes are not physically separated and are part of the closing mechanism (by including one of the actuator electrodes) it may cause the switch to close (hot switching), thus limiting the switch linearity by generation of harmonics. This is a known problem for transistor switches such as NMOS or FET. Thus, in order to minimize losses and improve the MEMS switch linearity, it is important to separate entirely the RF signal electrodes from the DC actuator electrodes. U.S. Pat. No. 6,876,282 describes various designs of composite metal-insulator MEMS switches. The preferred metal used is, typically, copper, while the insulator is silicon dioxide, resulting in full separation of the actuators from the RF signal carrying electrodes. In addition, Pat. application Ser. No. 10/315,335 describes the use of a metal ground plane 3–4 microns below the MEMS switch to improve its insertion loss switch characteristics.

As a result of the composite metal-insulator concept, MEMS switches can be fabricated using processes that are similar to the fabrication of copper chip wiring. Integration of MEMS switch with the back-end-of-the-line CMOS process limits the material set selection and the processing conditions and temperature to temperatures no greater than 400° C.

U.S. Pat. No. 5,578,976 to Yao et al. describes a micro-electromechanical RF switch, which utilizes a metal-metal contact in rerouting the RF signal at the switch closure. MEMS metal-to-metal switches have reported problems with increases contact resistance and contact failure during repeated operation, as described by J. J. Yao et al., in the paper "Micromachined low-loss microwave switches", J. MEMS, 8, 129–134, (1999), and in the paper "A low power/low voltage electrostatic actuator for RF MEMS applications", Solid-State Sensor and Actuator Workshop, 246–249, (2000). Switch failure at hot switching reported to be due to contact resistance increase and contact seizure as described by P. M. Zavracky et al. in the papers "Micromechanical switches fabricated using nickel surface micromachining", J. MEMS, 6, 3–9, (1997) and "Microswitches and microrelays with a view toward microwave applications", Int. J. RF Microwave Comp. Aid. Eng., 9, 338–347, (1999). Therein are reported an increased contact resistance and contact seizure, both of which can be associated with material transfer and arcing/welding. An Au—Au contact resistance increase to a value greater than 100 ohms was observed after two billion cycles of cold switching in $N_2$ (no current flow through the switch), while the contact seizure was observed with hot switched samples after a few million cycles in air, as described in the aforementioned first paper.

If the switch is packaged in a hermetic environment, the contamination build up caused switch failure is less likely than when exposed to ambient conditions. When the probability of formation of a contamination film is reduced, increases in contact resistance and/or contact seizure are both due to adhesion at the metal-metal contact. The increase in contact resistance most likely has to do with material transfer caused by surface roughening and results in reduced contact area. In the latter case the two metal surfaces are firmly adhered due to metal-metal bond formation (welding) at the interface. The invention described herein is a method of fabrication of a metal-metal switch with long lifetime and with stable and low contact resistance.

Accordingly, the main thrust for reducing adhesion while gaining adequate contact resistance is: 1) different metallurgy on each side of the contact—lattice mismatch reduces adhesion, and; 2) optimized hardness of the metals in contact—harder metal is expected to give lower adhesion.

The contact metallurgy is selected not only from the group of Au, Pt, Pd as in U.S. Pat. No. 5,578,976, but also from Ni, Co, Ru, Rh, Ir, Re, Os and their alloys in such a manner that it can be integrated with copper and insulator structures. Hard contact metals have lower contact adhesion. Furthermore, hardness of a metal can be changed by alloying. Au has low reactivity, but is soft and can result in contacts that adhere strongly. For instance, to avoid this problem, gold can be alloyed. Adding about 0.5% Co to Au increases the gold hardness from about 0.8 GPa to about 2.1 GPa. Moreover, hard metals such as ruthenium and rhodium are used as switch contacts in this invention. Dual layers, such as rhodium coated with ruthenium, with increasing melting point are used to prevent contact failure during arcing where high temperatures develop locally at the contacts.

SUMMARY OF INVENTION

The invention described herein teaches the use of noble materials and methods of integration (fabrication) with copper chip wiring forming the lower and the upper contacts of a MEMS switch. The upper contact is part of a movable beam. The integration schemes, materials and processes taught here are fully compatible with copper chip metallization processes and are typically, low cost, and low temperature processes below 400° C.

In a first aspect of the invention, there is provided a micro-electromechanical system switch that includes: a movable beam within a cavity, the movable beam being anchored to a wall of the cavity; a first electrode embedded in the movable beam; and a second electrode embedded in a wall of the cavity and facing the first electrode, wherein the first and second electrodes are respectively capped by a metallic contact.

In a second aspect of the invention, there is provided a micro-electromechanical system switch that includes: a movable beam within a cavity anchored to a wall of the cavity; at least one conductive actuation electrode embedded in a dielectric; a conductive signal electrode embedded in dielectric integral to the movable beam; a raised metallic contact capping the conductive signal electrode and a recessed metallic contact capping the movable beam conductive signal electrode.

BRIEF DESCRIPTION OF DRAWINGS

The accompanying drawings, which are incorporated in and which constitute a part of the specification, illustrate presently preferred embodiments of the invention and, together with the general description given above and the detailed description of the preferred embodiments given below; serve to explain the principles of the invention.

DETAILED DESCRIPTION

The invention will now be described with reference to FIGS. 1 and 2 by first discussing the integration and fabrication of the lower switch contact.

Figure 1A:
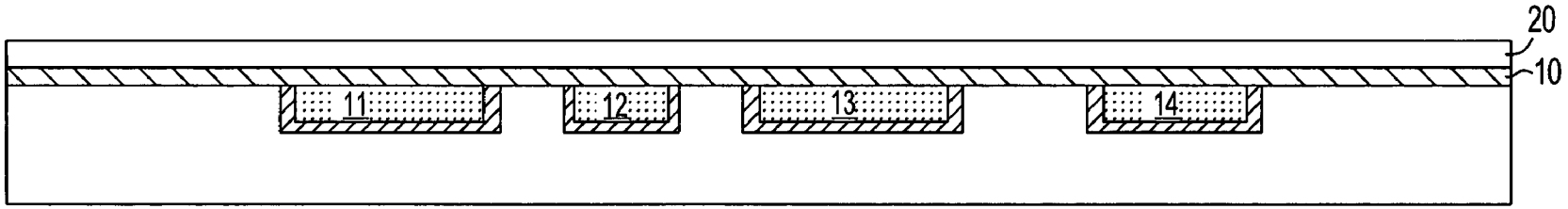
FIGS. 1*a*–1*f* are schematic diagrams of a cross-section of a first embodiment of the invention illustrating the process steps detailing the formation of a raised noble contact fabricated by blanket noble deposition and chemical mechanical planarization.
Figure 1B:
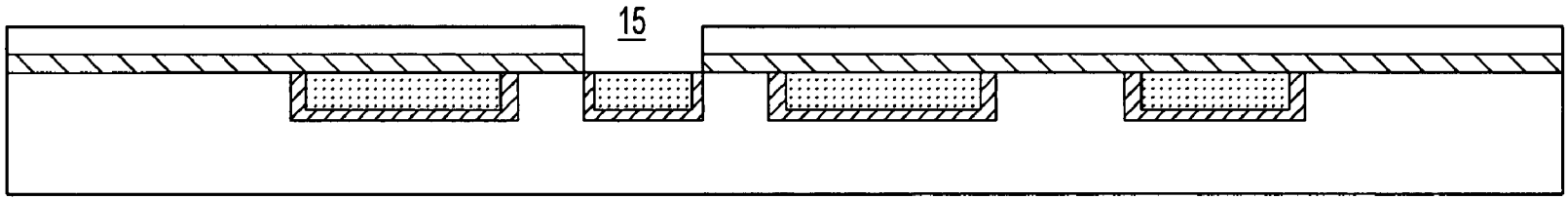
Figure 1C:
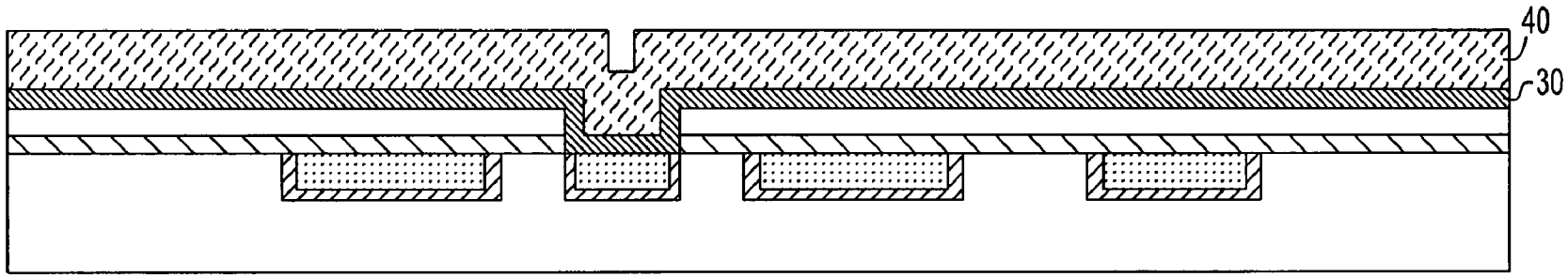
Figure 1D:
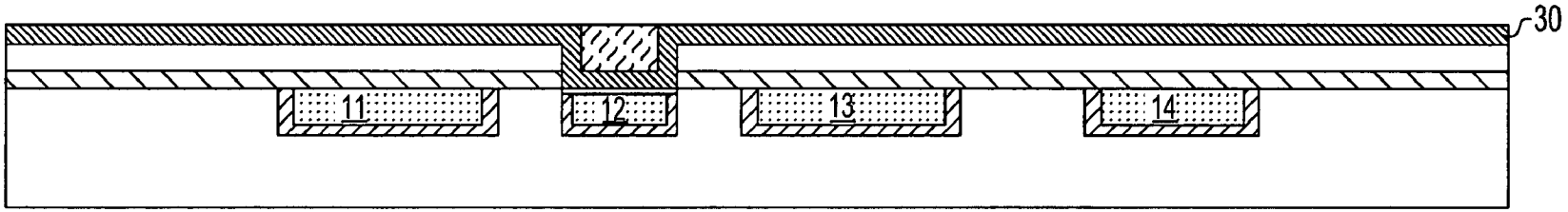
Figure 1E:
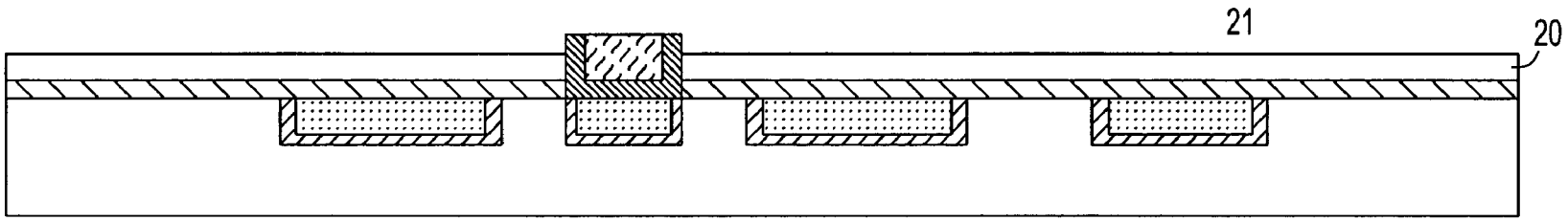
Figure 1F:
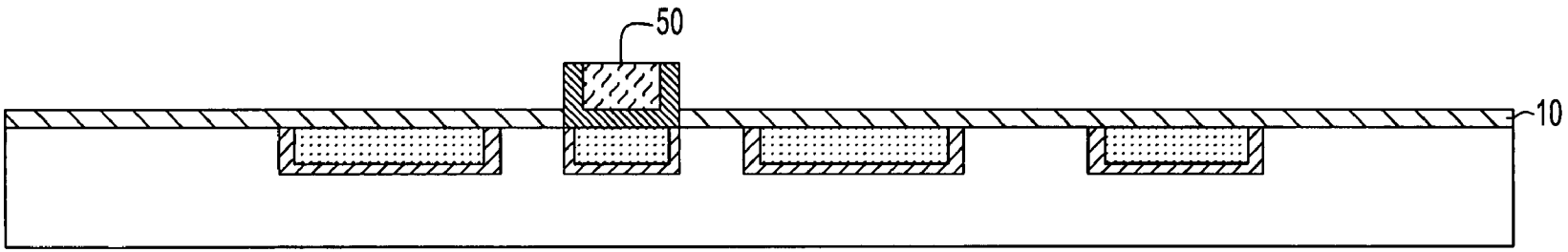

Two different approaches are used to deposit the contact material: blanket deposition methods and selective deposition methods. In one embodiment, a raised noble contact is formed by a blanket noble metal deposition and chemical mechanical planarization. A copper Damascene level is first embedded in silicon dioxide. The copper electrodes (11, 12, 13, and 14) are capped by a silicon nitride layer (10), typically, 500–1000 Å thick. Silicon oxide layer (20) having, preferably, a thickness of 1000–2000 Å is deposited thereon, is shown in FIG. 1*a*. Etching, preferably by way of photolithography and RIE (reactive ion etching) forms a contact pattern (15) into the oxide (20) and nitride layers (10) exposing copper (12), as shown in FIG. 1*b*. Next, a thin barrier layer is deposited by PVD, (physical vapor deposition) or CVD (chemical vapor deposition) such as Ta, TaN, W or dual layers, such as Ta/TaN, typically 50–700 Å thick (30, FIG. 1*c*). A blanket noble metal is deposited by PVD, CVD, or electroplating (40, FIG. 1*c*). The noble metal is shaped by a chemical-mechanical planarization process (CMP) stopping at the barrier metal Ta, TaN, W (30, FIG. 1*d*). Alternatively, if the noble metal CMP is not selective to the barrier layer metals the polish process can be stopped on the dielectric layer 20 which is not integral to the completed device. Noble metals that can be shaped by chemical-mechanical planarization (CMP) include Ru, Rh, Ir, Pt, and Re. Next, if required, the barrier metal (30) is removed in the field area by CMP stopping on silicon dioxide as shown in FIG. 1*e*. Silicon oxide (20) is removed by reactive ion etching stopping on silicon nitride (10) to yield a raised noble metal lower electrode (50, FIG. 1*f*).

In another embodiment, the raised electrode is formed by selective electroplating the noble contact. Selective electrolytic plating in the presence of a barrier layer has been discussed in U.S. Pat. No. 6,368,484 to Volant et al. and, more specifically, the selective electro-deposition of copper in Damascene features. The inventive method differs in that it forms a raised noble metal contact by selective electrodeposition through a mask.

Figure 2A:
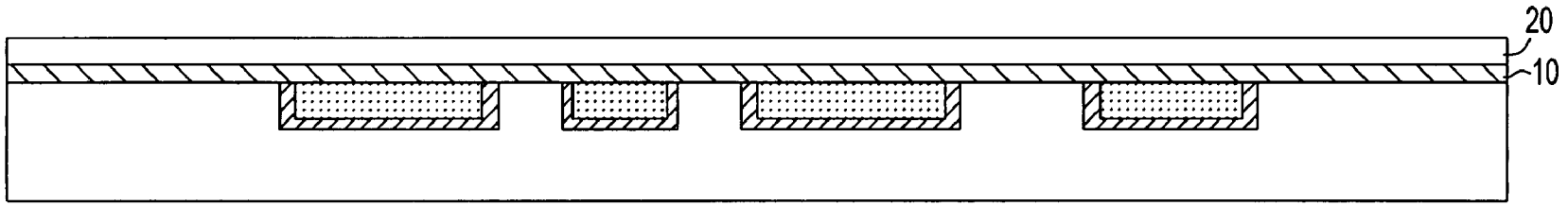
FIGS. 2*a*–2*f* are schematic diagrams of a cross-section of a second embodiment of the invention illustrating the process steps detailing the formation of a raised electrode fabricated by selective electroplating of the noble contact.
Figure 2B:
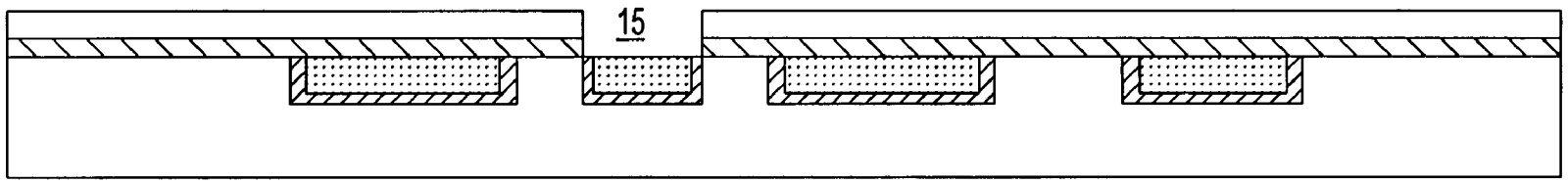
Figure 2C:
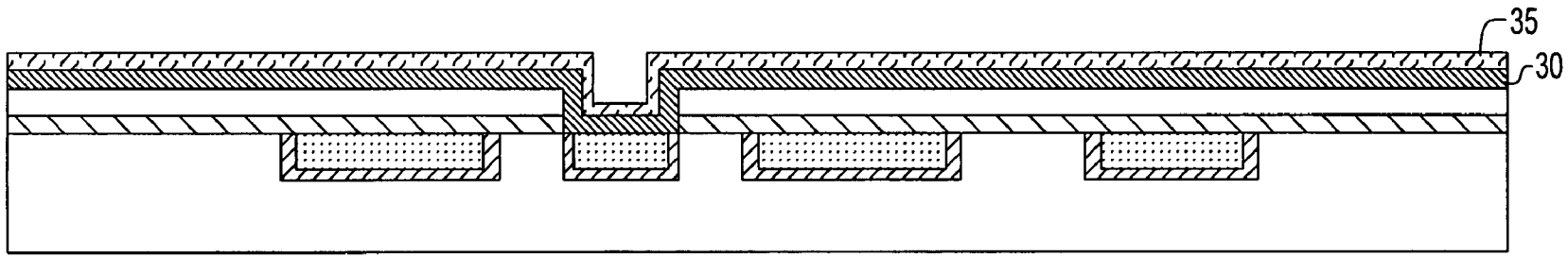
Figure 2D:
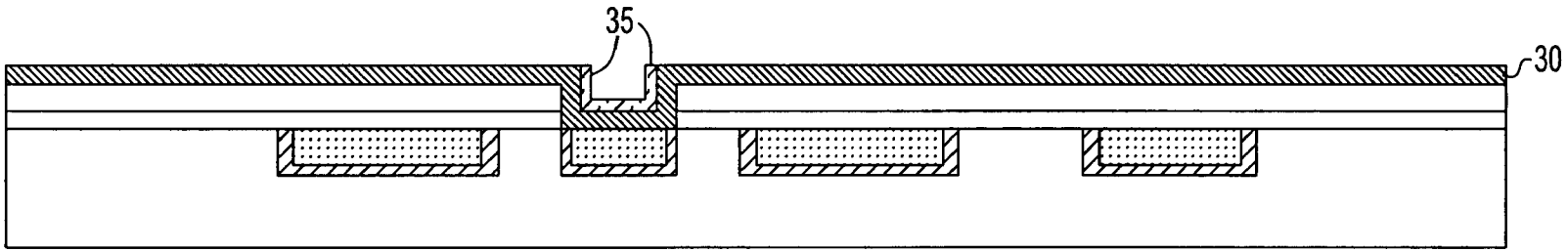
Figure 2E:
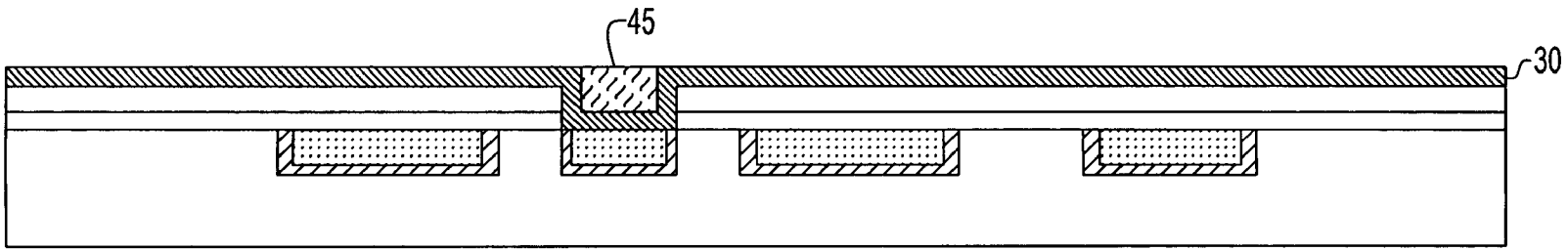
Figure 2F:
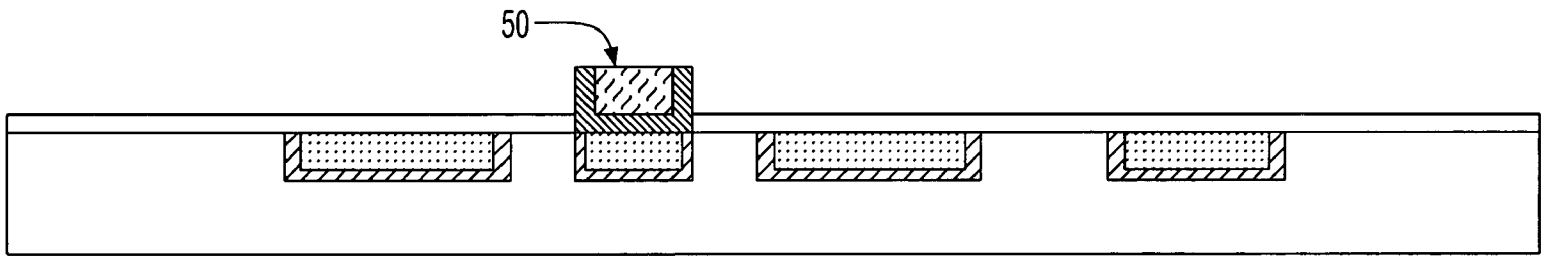
Figure 3A:
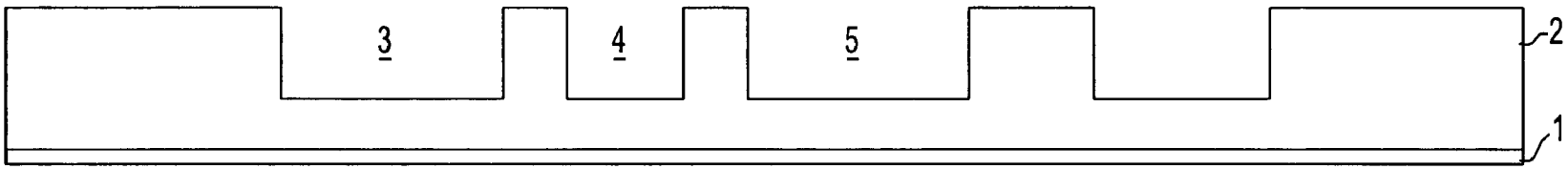
FIGS. 3*a*–3*e* are schematic diagrams of a cross-section of the MEMs switch illustrating a third embodiment of the invention for filling the electrodes of the first metal level with a noble metal using Damascene process.
Figure 3B:
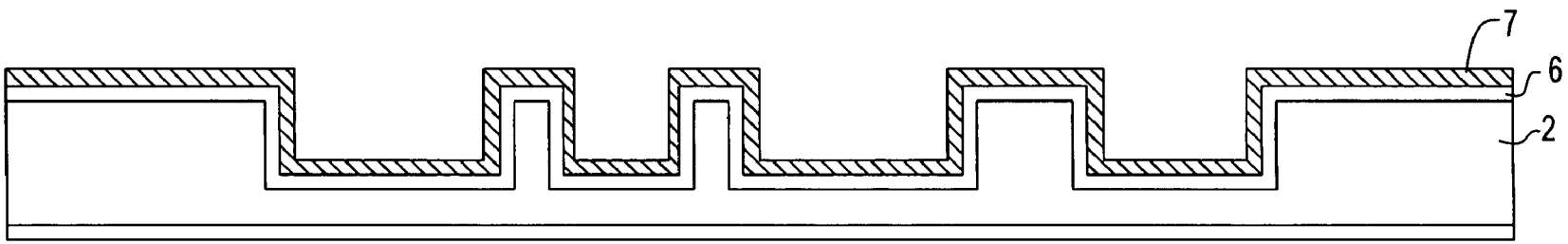
Figure 3C:
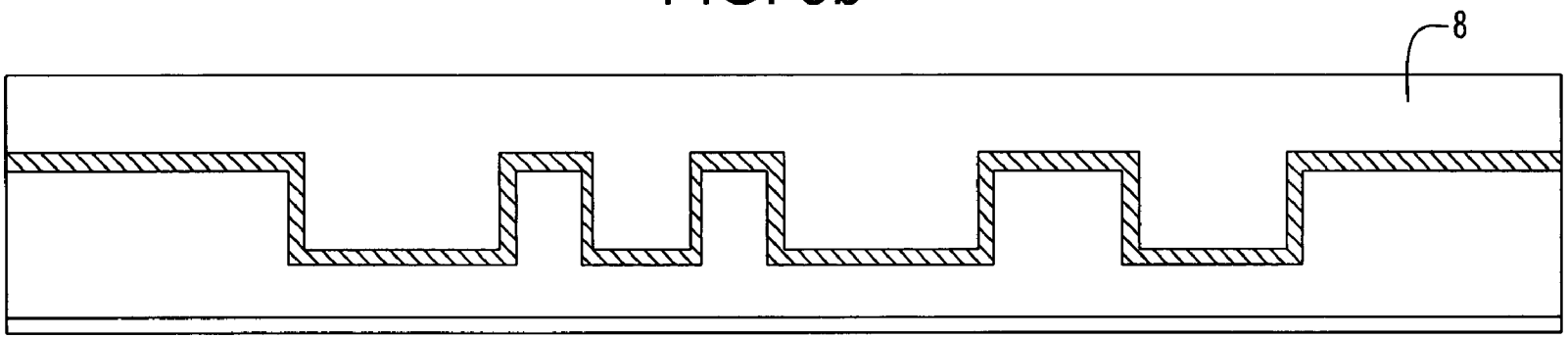
Figure 3D:
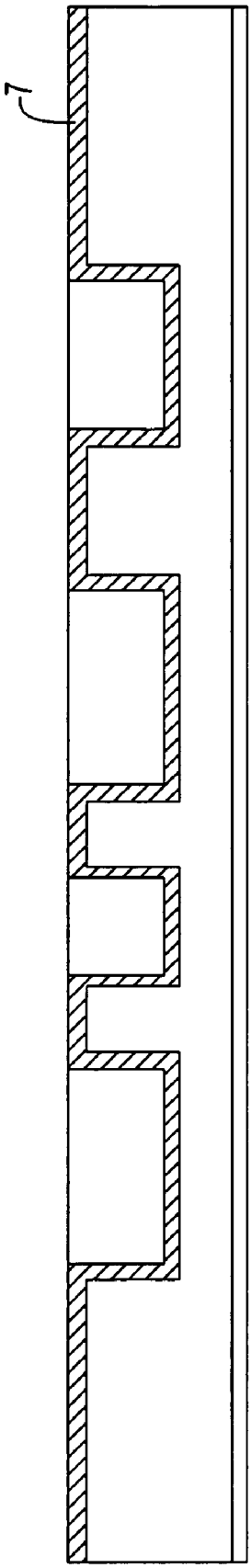
Figure 3E:
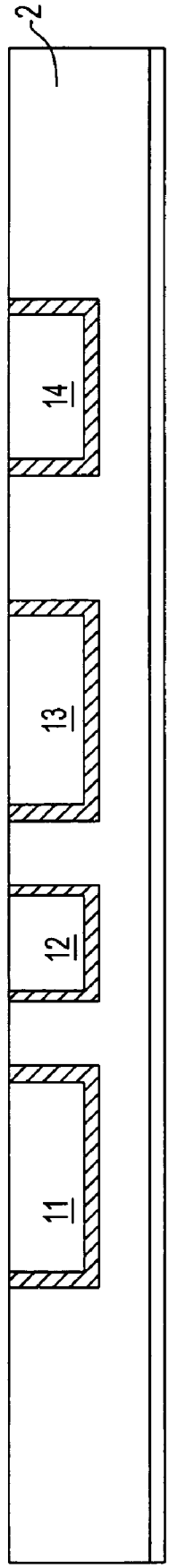

FIG. 2*a* shows that the process is initiated by way of a Damascene level that includes lower actuation electrodes (11, 13) and lower radio frequency (RF) signal electrode (12) shown in the middle of the structure, on top of which the raised noble contact is formed. All lower electrodes are capped by silicon nitride (10) and silicon dioxide (20). Referring now to FIG. 2*b*, the silicon dioxide (20) is patterned and etched by RIE leaving the copper of the middle electrode (12) exposed. A set of refractory metal barriers such as Ta, TaN, W (30) and a seed layer are then deposited by PVD or CVD methods. The thin seed layer (35) is then removed in the field area by CMP or ion milling, as shown in FIG. 2*d*. Typically after CMP, a subsequent short chemical etch step is needed to ensure that very thin layers of metal and/or metal islands are not present on top of TaN/Ta (30) in the field area. The barrier film with Ta/TaN is used to pass an electric current and is followed by a selective electrodeposition in the recess containing the seed layer (35) of noble metal such as Au, AuNi, AuCo, Pd, PdNi, PdCo, Ru, Rh, Os, Pt, PtTi, Ir (45). The selective electrodeposition does not nucleate on the refractory Ta or TaN (30) but will only nucleate on the noble seed layer (35), as shown in FIG. 2*e*. Next, the Ta/TaN (30) barrier is removed by CMP in the presence of the noble contact. The raised contact (50) is formed by etching (RIE) the silicon oxide layer (20) down to the silicon nitride (FIG. 2*f*).

There are two additional alternative methods for fabricating the lower contact electrodes. These offer the advantage of forming directly a noble contact on all the lower electrodes, i.e., both the lower actuation electrodes and the lower signal electrode. An obvious advantage that this offers is the elimination of the silicon nitride cap on top of the lower actuation electrodes (11, 13), resulting in a lower electrostatic actuation voltage required to move the MEMS switch beam. Another advantage is the simpler and fewer number of processing steps, in particular, lithographic steps that add cost to the total fabrication cost.

Referring back to FIG. 2, according to another embodiment, the electrodes of the first metal level (11, 12, 13, and 14) are filled with noble metal using a Damascene process. FIG. 3 shows the process sequence starting with a Si wafer (1), adding a silicon oxide layer (2), patterning the silicon oxide layer (2) to form the lower actuation electrodes (3, 5) and the signal electrode (4), depositing a barrier layer by CVD or PVD methods such as TaN/Ta (6), depositing a noble metal seed layer by CVD or PVD (7) and finally blanket depositing by PVD, CVD or electroplating the noble metal (8) to fill the Damascene structures (3, 4, 5), planarizing the noble metal (8) by CMP to expose the barrier film (7) and finally removing the barrier film (7) from the field area by CMP resulting in lower switch electrodes (11, 12, 13, 14) filled by noble metal.

Figure 4A:
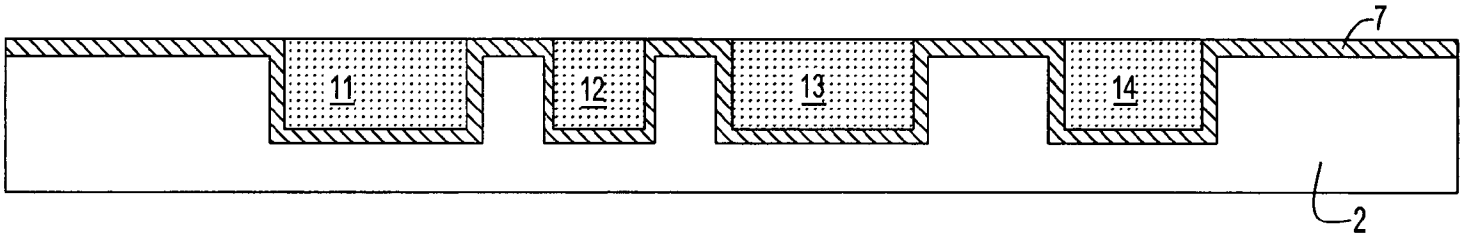
FIGS. 4*a*–4*d* are schematic diagrams of a cross-section of the MEMs switch illustrating the process steps for filling the first metal level electrodes with electroplated blanket copper metal and planarization stopping at the TaN/Ta barrier film.
Figure 4B:
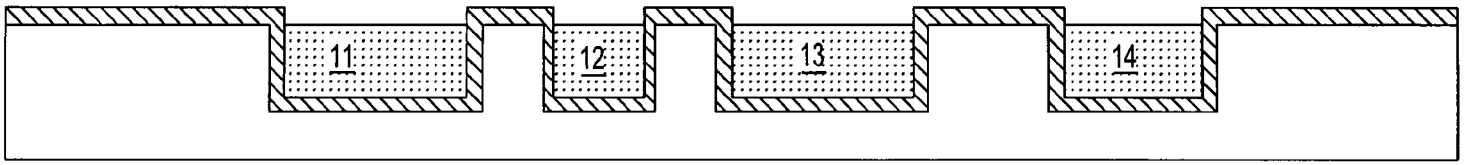
Figure 4C:
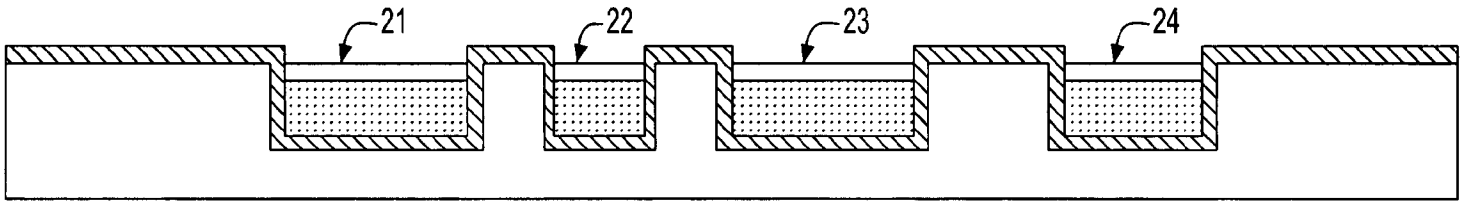
Figure 4D:
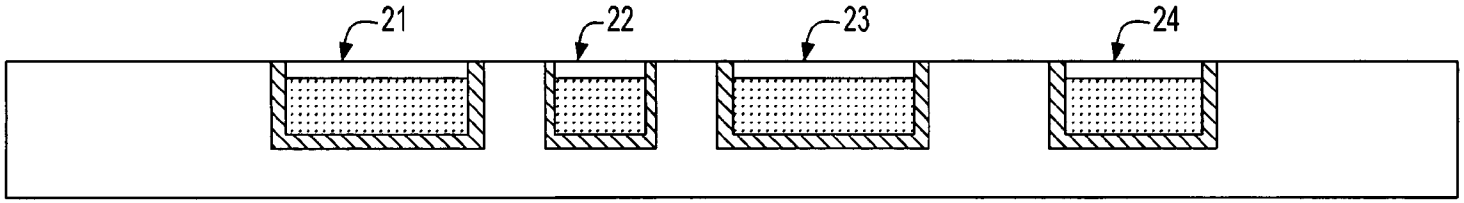

According to another embodiment shown in FIG. 4*a*, the first metal level electrodes (11, 12, 13, and 14) are filled with electroplated blanket copper metal and planarized, stopping at the barrier film TaN/Ta (7). As shown in FIG. 4*b*, the copper is recessed by chemical etching in the presence of the barrier layer TaN/Ta (7). This layer is then used to selectively electrodeposit a noble metal contact (21, 22, 23, 24) on top of the recessed copper electrodes (11, 12, 13, 14). There are several requirements for this noble metal contact fabrication scheme to work. For example, the noble metal on top of copper needs to be not only a diffusion barrier for copper but most importantly an oxygen barrier for copper because subsequent processing steps during the MEMS switch fabrication utilize oxygen plasma to remove the sacrificial material. Platinum, for instance, is not likely to be an oxygen barrier for copper, as described by D. E. Kotecki, et al., entitled "(Ba, Sr)$TiO_3$ dielectrics for future stacked-capacitor DRAM" published in IBM J. Res. Dev., 43, No. May 3, 1999, pp. 367–380. Therefore, it cannot be used alone as a contact material on top of copper. Combining more than one noble metal, such as dual layers of rhodium/ruthenium or ruthenium/platinum, is more likely to work effectively for suppressing copper diffusion, oxidation and switch contact failure.

Integration and Fabrication of Upper Switch Contact

FIG. 5 describes the formation of the upper contact. Referring now to FIG. 5*a*, after formation of the lower switch contact, an organic blanket layer of sacrificial material is deposited. Organic material (60), such as SiLK or diamond-like-carbon (DLC), is deposited followed by a thin silicon nitride layer (70) and by silicon dioxide (80. Optionally, a thin refractory metal (90) is used to improve adhesion of noble metals for sub titlesubsequent processing and to act as an additional hardmask for reactive ion etching. Metal hardmasks are deposited by PVD, CVD or IMP (ionized metal physical vapor deposition). Refractory metals such as Ta, TaN or W can be used, although TaN is preferred over other hardmask materials because of its improved adhesion to silicon dioxide (80). FIG. 5*b* shows the formation of a flat recess (100) by lithography, and the refractory metal (i.e., hardmask) (90) patterned and etched by wet etching or RIE. Recess (100) is formed in the sacrificial organic layer (60) by a plasma process. The recess process can be tailored so that the upper contact is shaped in such a way so that it results in optimum contact between the upper and the lower contact. One way of generating the upper contact shown in FIG. 5*b*, is by creating a flat surface and avoiding roughness when etching the organic layer during recessing. The area of the upper contact is designed so that when in contact with the lower contact, it falls within the contact area of the lower contact. To improve contact to rougher surfaces small area contacts are formed, as shown in FIGS. 5*c* and 5*d*. The organic layer is recessed by first etching the metal hardmask layer 90, and dielectric layers 80 and 70 with at least one RIE step. During RIE microtrenching often occurs and results in uneven etching local to the feature edge. The formation of microtrenching is used, in this application, to provide fangs at the feature edges which protrude into the organic layer. Creating small area points of contact is preferable to generate increased contact pressure for the same applied force.

Figure 5A:
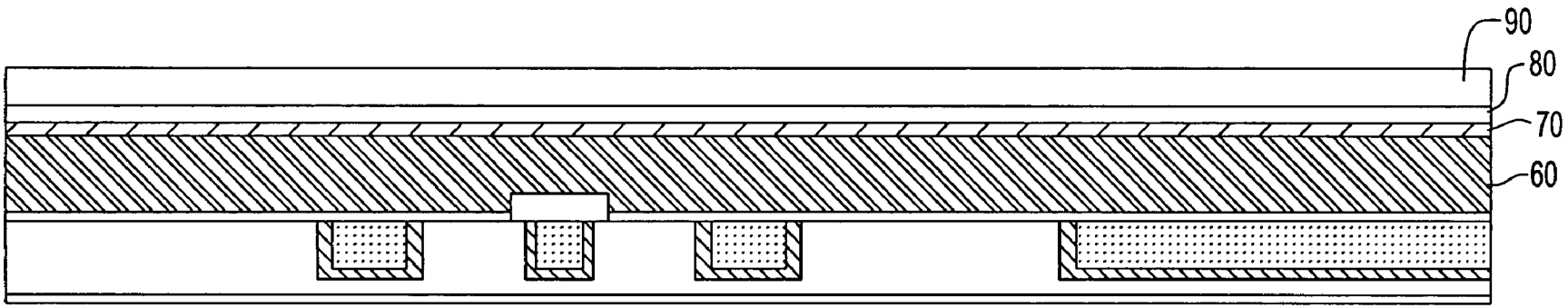
FIGS. 5*a*–5*f* are schematic diagrams of a crosssection of the MEMs showing the formation of the upper contact of the switch.
Figure 5B:
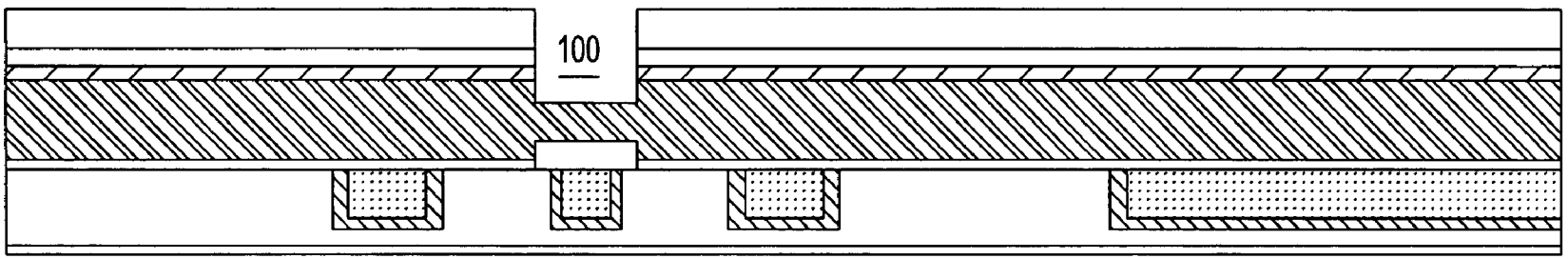
Figure 5C:
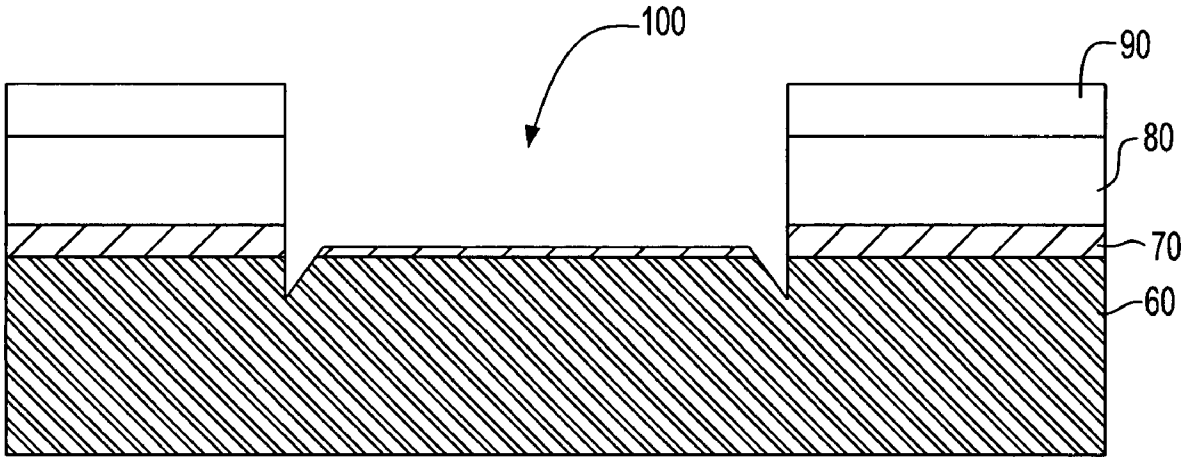
Figure 5D:
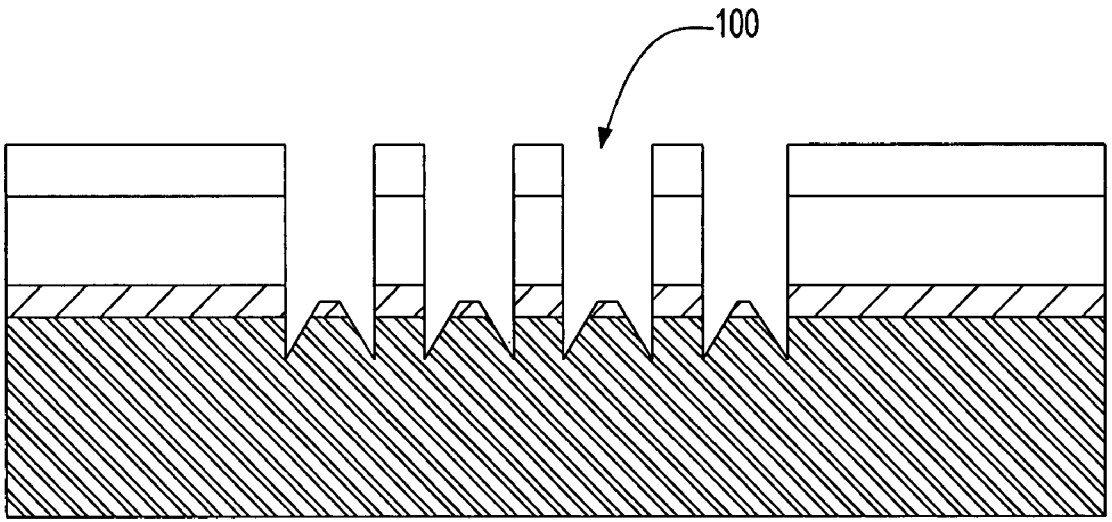
Figure 5E:
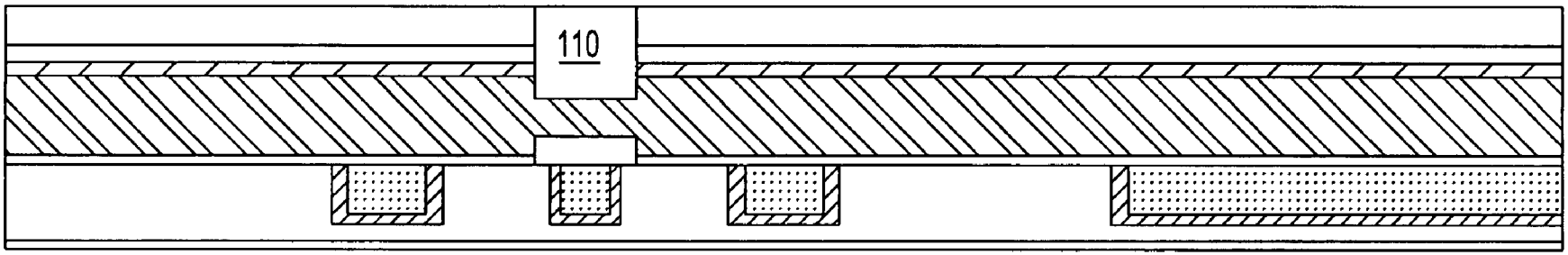
Figure 5F:
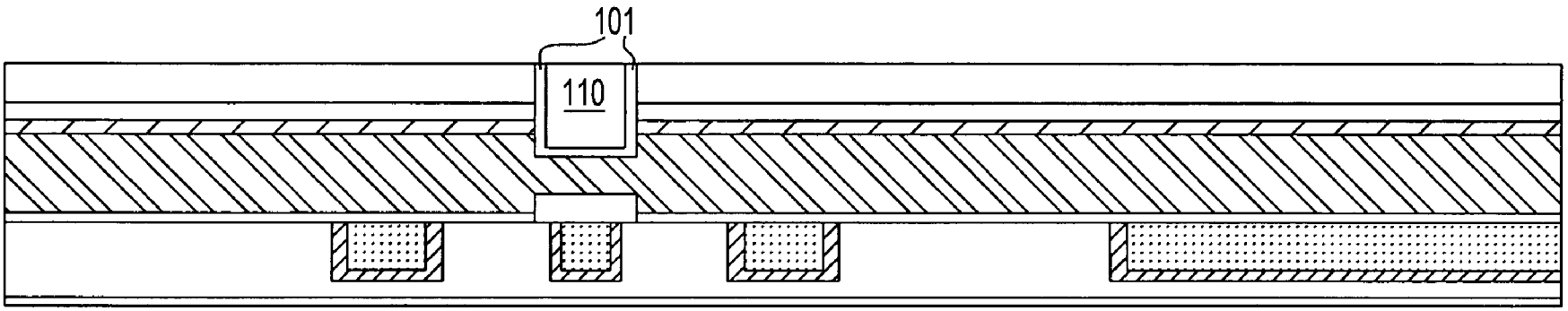

After forming recess (100), the feature is filled with a blanket noble metal layer (110) using a non-selective deposition technique, such as PVD, CVD or electroplating and CMP as shown in FIG. 5*e*. The metal of choice for the upper contact is not necessarily the same as the noble metal of the lower contact but it is selected from the same material set, e.g., Au, AuNi, AuCo, Pd, PdNi, PdCo, Ru, Rh, Re, Os, Pt, PtTi, Ir and their alloys. The blanket noble metal layer is typically formed by chemical-mechanical planarization to yield the upper contact (110) but may be selectively electroplated to minimize effects of metal overburden during noble metal CMP. The selective electroplating process requires that there be a thin seed layer (101) deposited within the recess and in the field area on top of the hardmask (80). The seed layer (101), having a thickness ranging from 100 to 1000 Å is then removed from the hardmask area by CMP or ion milling. Ruthenium, rhodium and iridium, are preferred to form the seed layers for through-mask selective electroplating because there are exists CMP processes that have been developed for these three noble metals. Selective electroplating of the noble metal or alloy occurs only within the recess (90) and on top of the seed layer (101). The upper contact (110) after selective electroplating is shown in FIG. 5*f*.

Figure 6A:
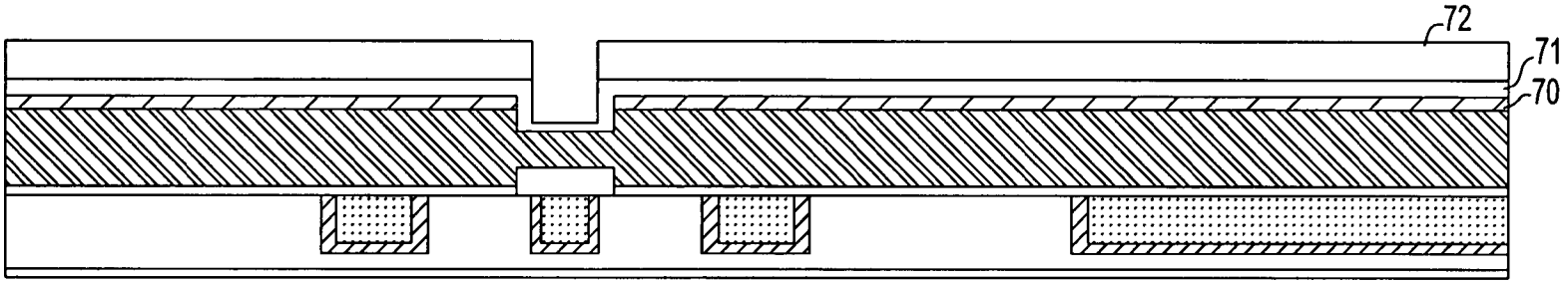
FIGS. 6*a*–6*d* are schematic diagrams showing a cross-section of the MEMs representing the process sequence for creating the upper switch contact using electroplating through a photoresist mask.
Figure 6B:
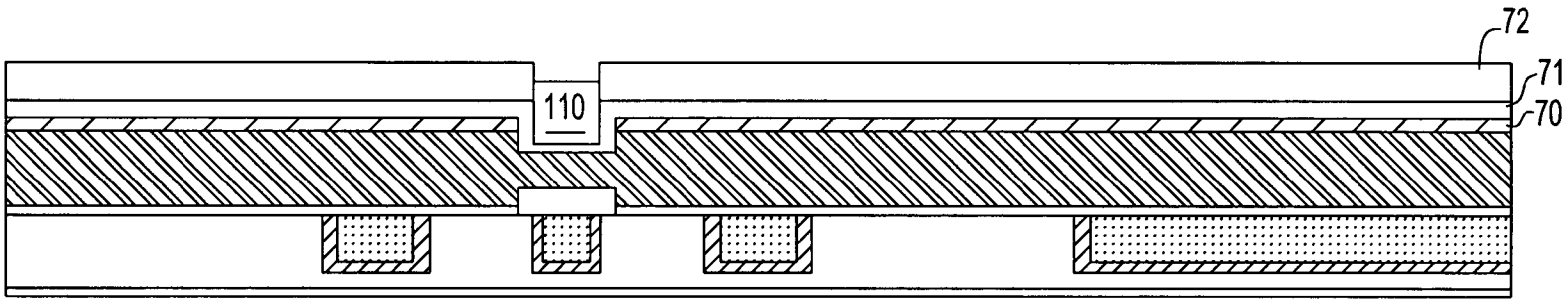
Figure 6C:
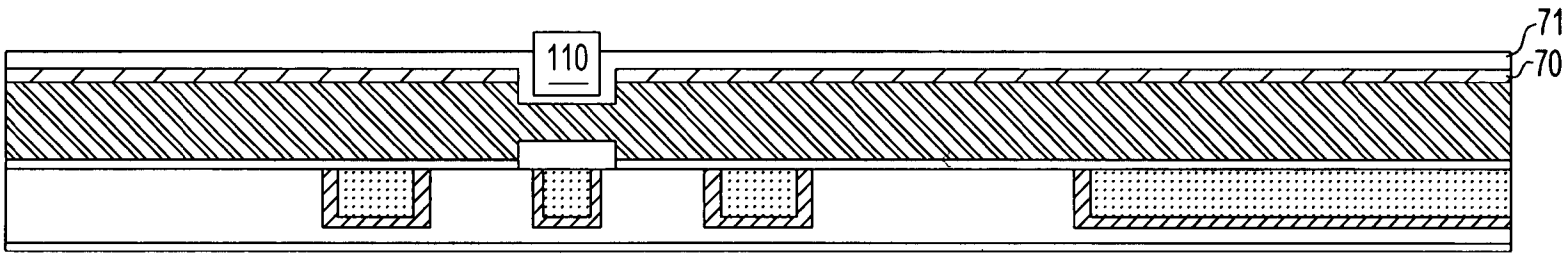
Figure 6D:
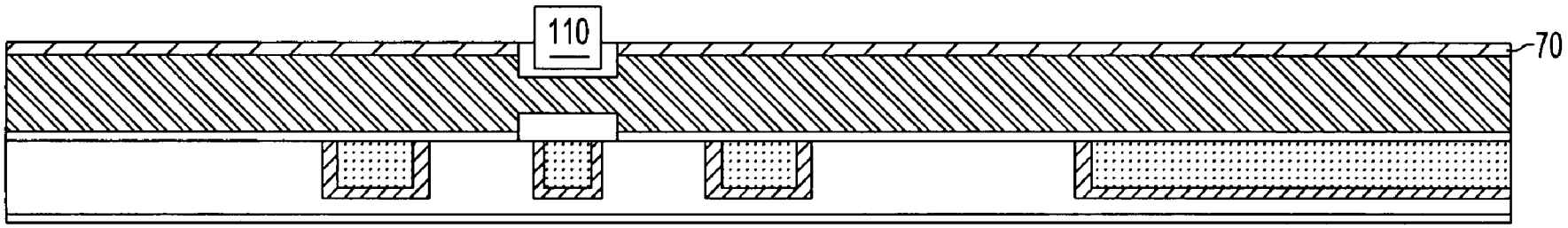

A final embodiment for creating the upper switch contact is to use electroplating through a photoresist mask. The process sequence is described in FIG. 6*a* through 6*e*. Similar to the process described in FIG. 5, after formation of the lower switch contact, an organic blanket layer of sacrificial material is deposited. The organic material (60) such as SiLK or diamond-like-carbon (DLC) is deposited. Subsequently, a thin silicon nitride layer (70) is deposited. The nitride layer (70) is patterned and etched creating a recess (90) in the organic sacrificial layer (60). A blanket noble metal thin seed layer (71) is deposited on top of the silicon nitride layer (70) to be used to pass electric current during noble metal electrodeposition. A photoresist mask (72) is applied on top of the noble seed layer (71), as shown in FIG. 6*a*. The upper contact (110) is then formed by selectively electroplating where the photoresist mask has exposed the thin noble metal seed layer, as shown in FIG. 6*c*. The photoresist mask (72) is then stripped off (FIG. 6*c*) and the remaining noble metal seed layer (71) is removed by ion milling or chemical etching (FIG. 6*d*).

Figure 7A:
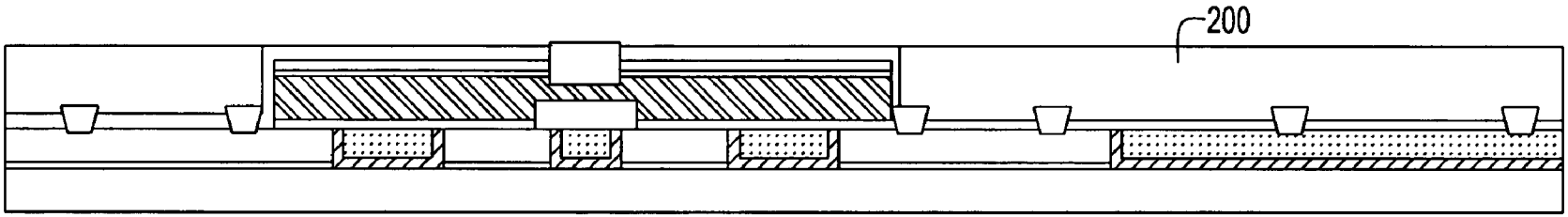
FIGS. 7*a*–7*f* are schematic diagrams showing crosssections of the MEMs representing the process sequence to complete the device after the upper switch contact has been formed.
Figure 7B:
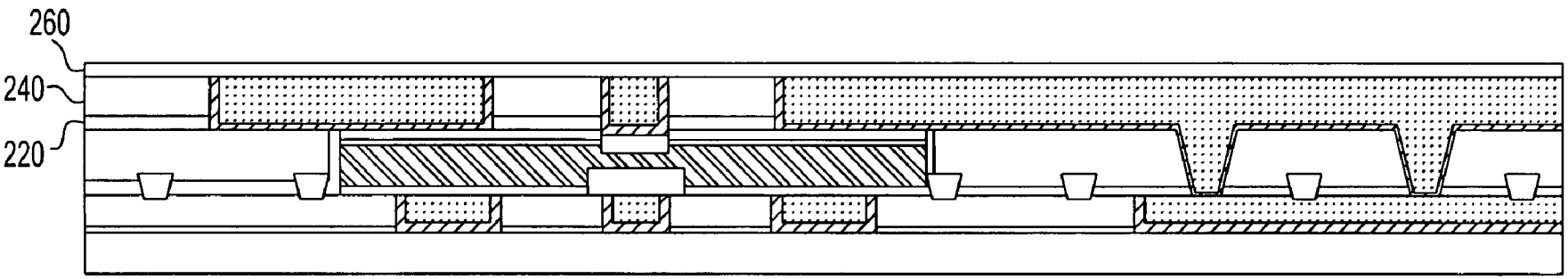
Figure 7C:
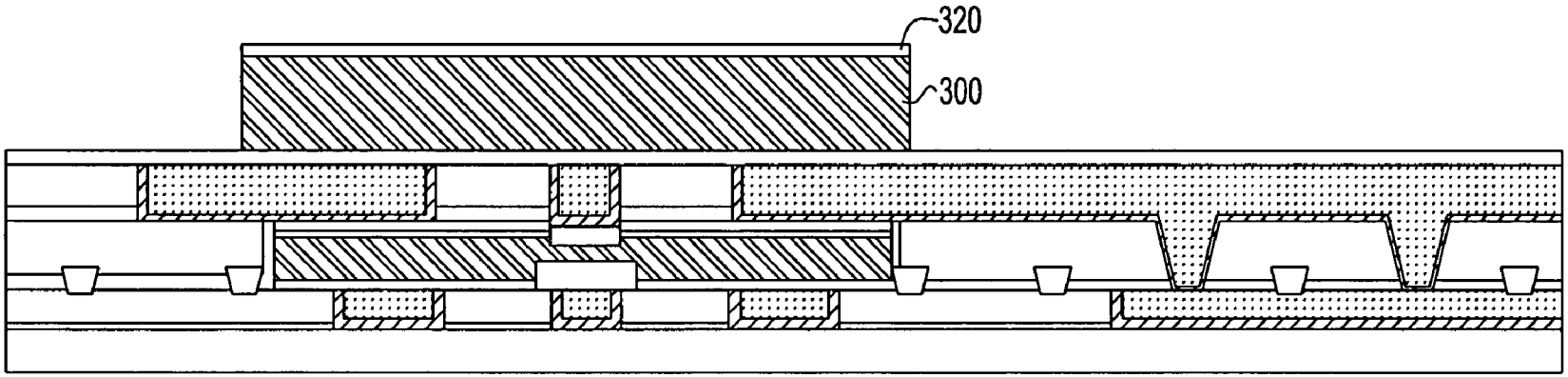
Figure 7D:
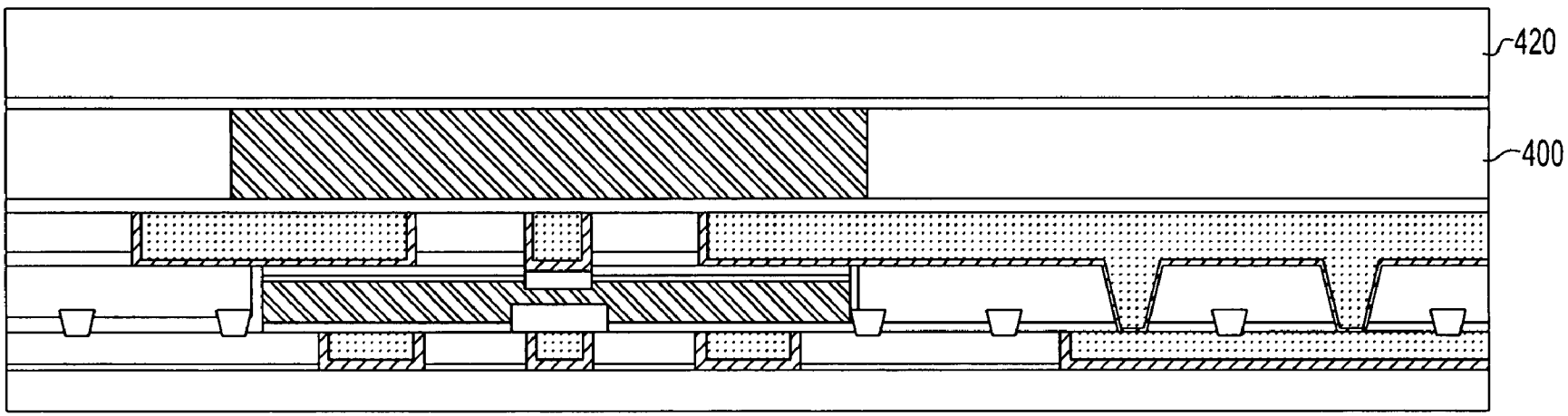
Figure 7E:
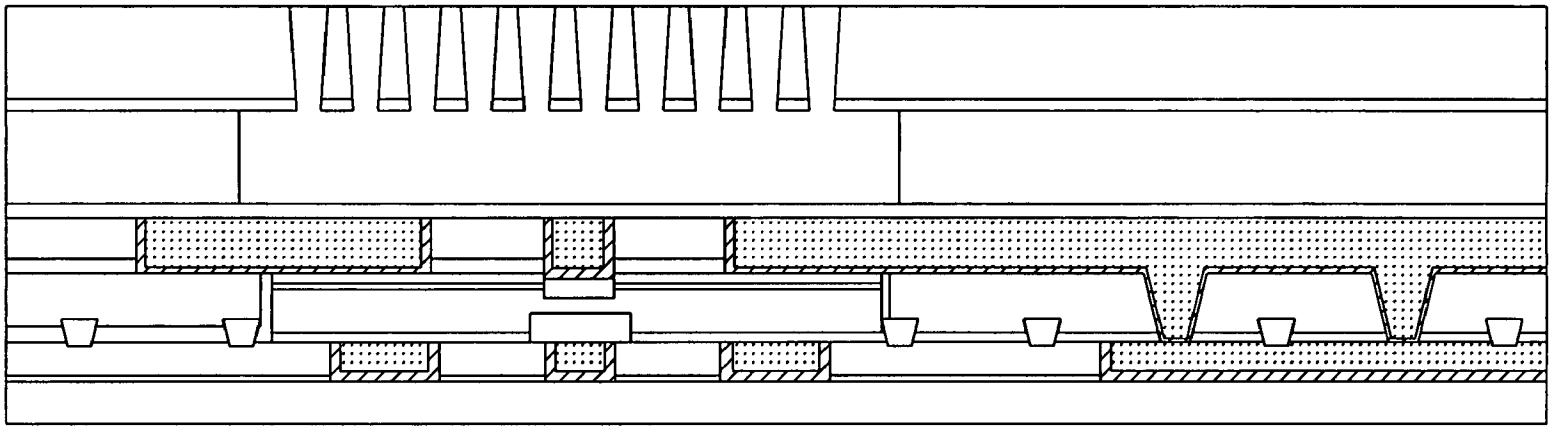
Figure 7F:
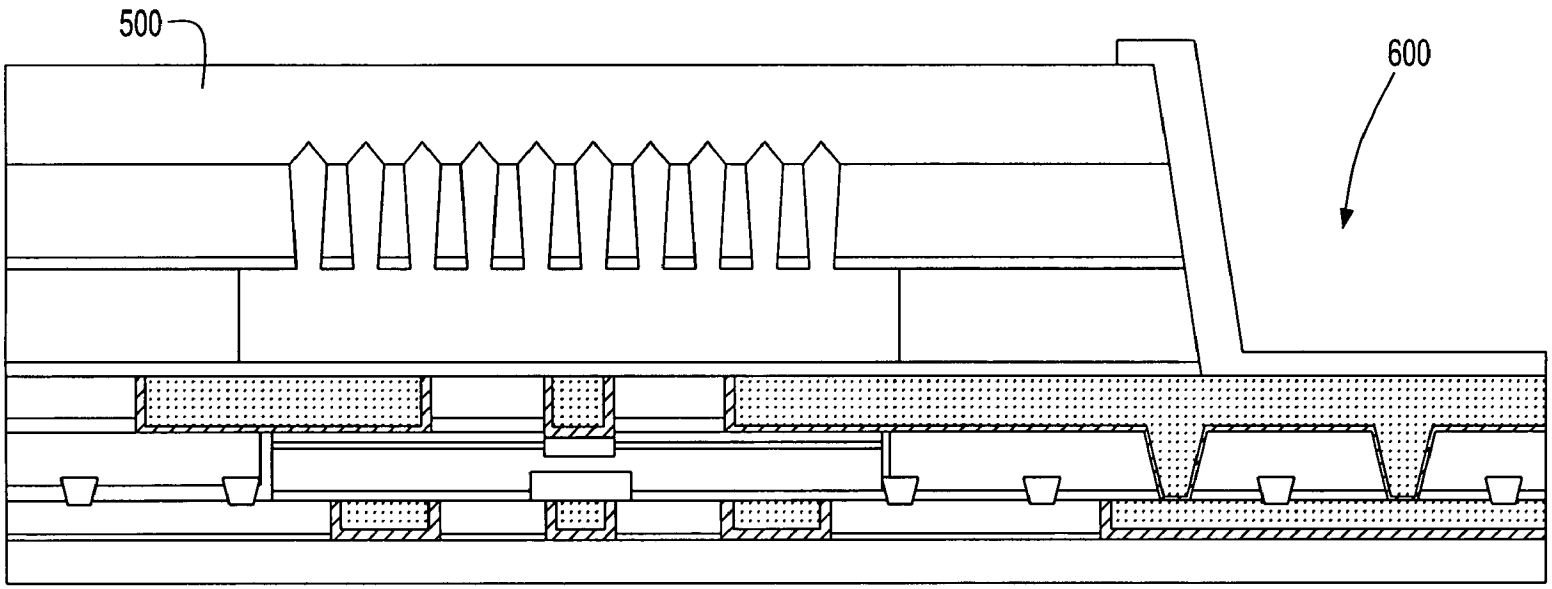

The organic layer (60) and dielectric layers (70, 80) are then patterned and backfilled with additional dielectric (200) and planarized with CMP as shown in FIG. 7*a*. Next a Dual Damascene copper level is formed in dielectric layers (220, 240 and 200) and capped with silicon nitride (260) as shown in FIG. 7*b*. The planar structure is then patterned and RIE'ed to open the dielectric stack layers (70, 80, 220, 240 and 260) to expose the organic layer (60). Additional organic material 300 is then deposited capped with silicon nitride (320) and patterned by RIE to produce the cross section shown in FIG. 7C. A backfill dielectric (400) is then deposited and planarized and additional dielectric (420) is deposited on the planar surface as shown in FIG. 7*d*. Access vias are now formed in the dielectric layer (420) exposing the organic layer (300) to facilitate device release. The sample is then exposed to an oxygen ash which removes organic layers (300, 60). The device is then sealed by depositing a pinch-off layer (500) and a final series of lithography and RIE are used to form contact (600) for wire bonding or solder ball chip formation. To ascertain improved reliability over extended switch operation, it is preferred that the switch is fully encapsulated in an inert environment with He, $N_2$, Kr, Ne, or Ar gas.

While the present invention has been described in terms of several embodiments, those skilled in the art will realize that various changes and modifications can be made to the subject matter of the present invention all of which fall within the scope and the spirit of the appended claims.

Having thus described the invention, what is claimed as new and desired to secure by Letter Patent is as follows.

The invention claimed is:

1. A micro-electromechanical system (MEMS) switch comprising:

a movable beam within a cavity, said movable beam being anchored to a wall of said cavity;

a first electrode embedded in said movable beam; and a second electrode embedded in an wall of said cavity, facing said first electrode, wherein said first and second electrodes are respectively capped by a metallic contact, wherein said first electrode is a signal electrode and said second electrode is an actuation electrode.

2. The MEMS switch as recited in claim 1, wherein said metallic contact of said first and second electrodes respectively protrude above said first electrode and below said second electrode.

3. The MEMS switch as recited in claim 1, wherein the metallic cap of said first and second electrodes is made of a planarized blanket deposition of noble material.

4. The MEMS switch as recited in claim 3, wherein said actuation and signal electrodes are made of copper.

5. The MEMS switch as recited in claim 1, wherein said movable beam is anchored to the wall of said cavity at least one end thereof.

6. The MEMS switch as recited in claim 1 where said metallic contact is selected from the group consisting of Au, AuNi, AuCo, Pt, PtNi, Ru, Ru, Rh, Os. Ir, Pd, PdNi, and PdCo.

7. The MEMS switch as recited in claim 1, wherein said cavity is filled with gas, said gas being selected from the group consisting of nitrogen, helium, neon, krypton and argon.

8. The MEMS switch as recited in claim 1, wherein the metallic contact of said second electrode has a flat surface that is smaller than the surface of the metallic contact of said first electrode.

9. A micro-electromechanical system (MEMS) switch comprising:

a movable beam within a cavity anchored to a wall of the cavity;

at least one conductive actuation electrode embedded in a dielectric;

a conductive signal electrode embedded in dielectric integral to said movable beam; and a raised metallic contact capping said conductive signal electrode and a recessed metallic contact capping said actuation electrode.

10. The MEMS switch as recited in claim 9, wherein said dielectric is made of SiN, $SiO_2$, SiON, SiCH, SiCOH, SiCHN, $TiO_2$, $ZrO_2$, $HFO_2$, $Al_2O_3$, $Ta_2O_3$ and combinations thereof.

11. The MEMS switch as recited in claim 9, wherein said caps of conductive signal electrodes are made of noble material, and said actuation and signal electrodes are made of copper.

12. The MEMS switch as recited in claim 9, wherein said recessed metallic contact is made of a material selected from the group consisting of Au, AuNi, AuCo, Pt, PtNi, Ru, Rh, Os. Ir, Pd, PdNi, and PdCo.

13. The MEMS switch as recited in claim 9, wherein an exposed surface of said actuation electrode is recessed below an exposed surface of said dielectric, and said cap superimposed on top of said actuation electrode matches the exposed surface of said dielectric.

* * * * *